US005134934A

United States Patent [19]

Knauer et al.

[11] Patent Number: 5,134,934

[45] Date of Patent: Aug. 4, 1992

[54] PRINTING SYSTEM FOR FLYING PLATE CHANGE

[75] Inventors: Peter Knauer, Münster/Lech; Erich Wech, Augsburg, both of Fed. Rep. of Germany

[73] Assignee: Man Roland Druckmaschinen AG, Offenbach am Main, Fed. Rep. of Germany

[21] Appl. No.: 706,883

[22] Filed: May 29, 1991

[30] Foreign Application Priority Data

Jul. 10, 1990 [DE] Fed. Rep. of Germany ..... 4021895

[51] Int. Cl.[5] ..... B41F 7/08; B41F 7/12; B41F 31/14

[52] U.S. Cl. ..... 101/143; 101/218; 101/220; 101/352

[58] Field of Search ..... 101/137-140, 101/142-144, 147, 177, 179, 180, 182, 184, 218, 220, 221, 349-352, 415.1

[56] References Cited

U.S. PATENT DOCUMENTS

| | | | |
|---|---|---|---|
| 1,554,597 | 9/1925 | Rowles | 101/218 |
| 2,425,167 | 8/1947 | Whitehead | 101/90 |
| 2,444,547 | 7/1948 | Whitehead | 101/247 |
| 4,397,237 | 8/1983 | Makosch | 101/352 |
| 4,776,811 | 8/1988 | Linska | 101/415.1 |
| 4,821,640 | 4/1989 | Hajek et al. | 101/220 |
| 4,919,046 | 4/1990 | Kakko-Chiloff | 101/143 |
| 5,063,844 | 11/1991 | Fausel | 101/352 |

FOREIGN PATENT DOCUMENTS

| | | |
|---|---|---|
| 0028677 | 5/1981 | European Pat. Off. . |
| 1561091 | 1/1970 | Fed. Rep. of Germany . |
| 2845932 | 4/1980 | Fed. Rep. of Germany . |
| 3329331 | 3/1985 | Fed. Rep. of Germany . |
| 9000336 | 3/1990 | Fed. Rep. of Germany . |

*Primary Examiner*—Edgar S. Burr
*Assistant Examiner*—Stephen R. Funk
*Attorney, Agent, or Firm*—Frishauf, Holtz, Goodman & Woodward

[57] ABSTRACT

To permit flying plate change of printing plates (14, 15; 28, 29) on plate cylinders (10, 11; 24, 25) of an offset printing system having blanket cylinders (1,2), one of which can function as an impression cylinder (2, 1), the plate cylinders, to maintain register, are axially fixed in the frame (3) of the printing machine, but the blanket cylinders are movable by an eccenter system between three positions (6, 7, 8) and an ink application roller (16) to which also damping fluid can be applied from a damper (20) is selectively engageable with either one of the plate cylinders. Thus, only the blanket cylinder (1, 2) and the associated impression cylinder (2, 1) need be shifted for respective engagement with the plate cylinders, and register alignment of the plate cylinders is maintained. An ink application roller is selectively engageable with the plate cylinders, for example by being supported on a swing shaft or a swing lever (17), with which also a damping fluid application roller (19) is engageable.

14 Claims, 2 Drawing Sheets

PRINTING SYSTEM FOR FLYING PLATE CHANGE

Reference to related publication:
German Utility Model DE-GM 84 10 619.

FIELD OF THE INVENTION

The present invention relates to printing machinery, and more particularly to a printing system permitting flying change of a printing plate, so that, while the machine is printing information from a first printing plate on a first plate cylinder, the printing plate on a second printing cylinder can be changed, to permit rapid change-over of printing information to the second printing plate, for replacement of the printing plate on the first cylinder. All this can be carried out without interruption of printing. The invention is particularly applicable to offset web printing machines having at least one inker and at least one damper.

BACKGROUND

An offset printing system having two plate cylinders which can be associated with a blanket cylinder has previously been proposed. The plate cylinders can be horizontally disengaged from the blanket cylinder. If each of the plate cylinders includes adjustment systems, for example to correct copying of printing errors, deviations upon bending, or clamping of the printing plates, and adjustment arrangements for lateral, circumferential and diagonal register, it becomes difficult to shift the plate cylinders while maintaining register for further printing. The system, further, is very complex, as illustrated in the publication describing the system, German Utility Model DE-GM 84 10 619. The system further requires separate disengagement systems in order to counteract damage if, possibly, the web might tear.

THE INVENTION

It is an object to provide a printing system in which the plate cylinders need not be moved upon plate change.

Briefly, two plate cylinders are positioned in a machine frame in essentially axially predetermined, e.g. adjusted position with respect to each other. The blanket cylinder of the system is positioned in the machine frame such that its axis of rotation can be shifted between three positions which place the blanket cylinder in engagement, selectively, with either one of the plate cylinders, or neither one of the plate cylinders, that is, out of engagement with both plate cylinders and further out of engagement with an impression cylinder, for permitting threading of a substrate web between the blanket cylinder and the impression cylinder; the inker is selectively engageable with either one of the plate cylinders.

The system has the advantage that the register determined and adjusted once for one or both of the plate cylinders need not be disturbed when changing the plate on one of the plate cylinders.

DRAWINGS

DETAILED DESCRIPTION

Figure 3:
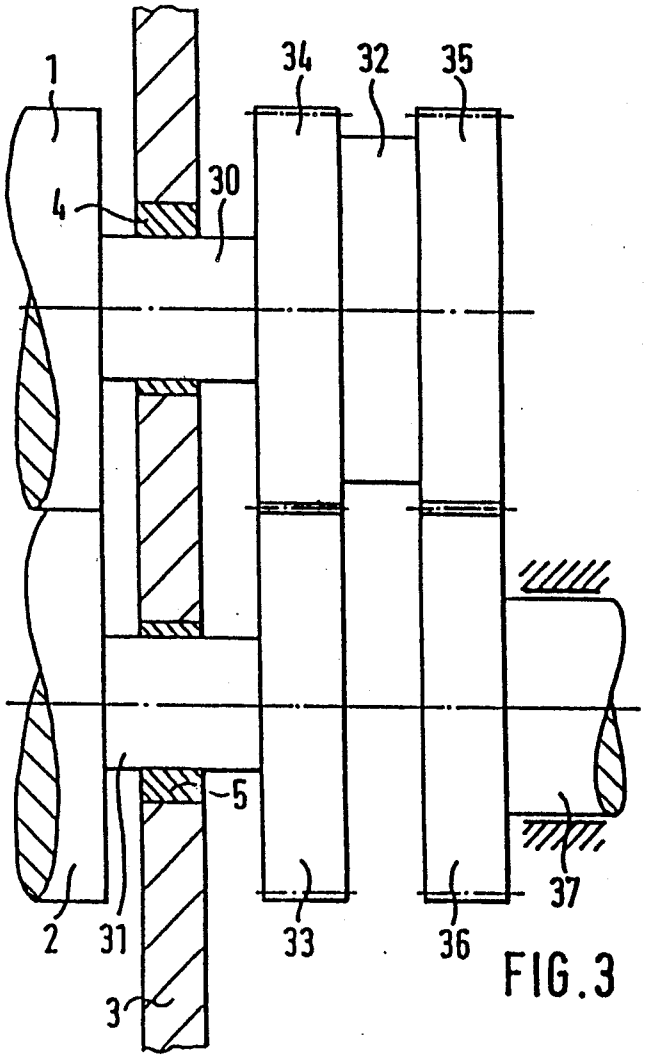
FIG. 3 is a schematic side view of a drive for two blanket cylinders, one of which will form an impression cylinder, omitting all elements not necessary for an understanding of the present invention.

The invention will be described in connection with a dual printing system, arranged for perfect printing. Two blanket cylinders 1, 2 are provided, in which one of the blanket cylinders forms an impression cylinder for the other one. The blanket cylinder 1 and the counter or impression blanket cylinder 2 are located in side walls of the printing machine. FIG. 3 illustrates, schematically, only one of the side walls.

In accordance with a feature of the invention, the blanket cylinders are located in the side walls of the printing machine in eccenter bearings 4, 5. The eccenter bearings 4, 5 can be of any well known and suitable construction, and are so arranged that the blanket cylinder 1 or 2, respectively, can be shifted between three positions 6, 7, 8. The blanket cylinder 2 is likewise movable between the three positions. The three positions can be set and fixed. A substrate web 9, for example paper, is guided between the blanket cylinder 1 and the counter or impression blanket cylinder 2 (see FIG. 1).

To permit some wrap-around of the web 9, which is guided horizontally about the blanket cylinders, the axes of rotation of the blanket cylinder 1 and of the blanket cylinder 2 are located to be inclined with respect to each other.

Figure 1:
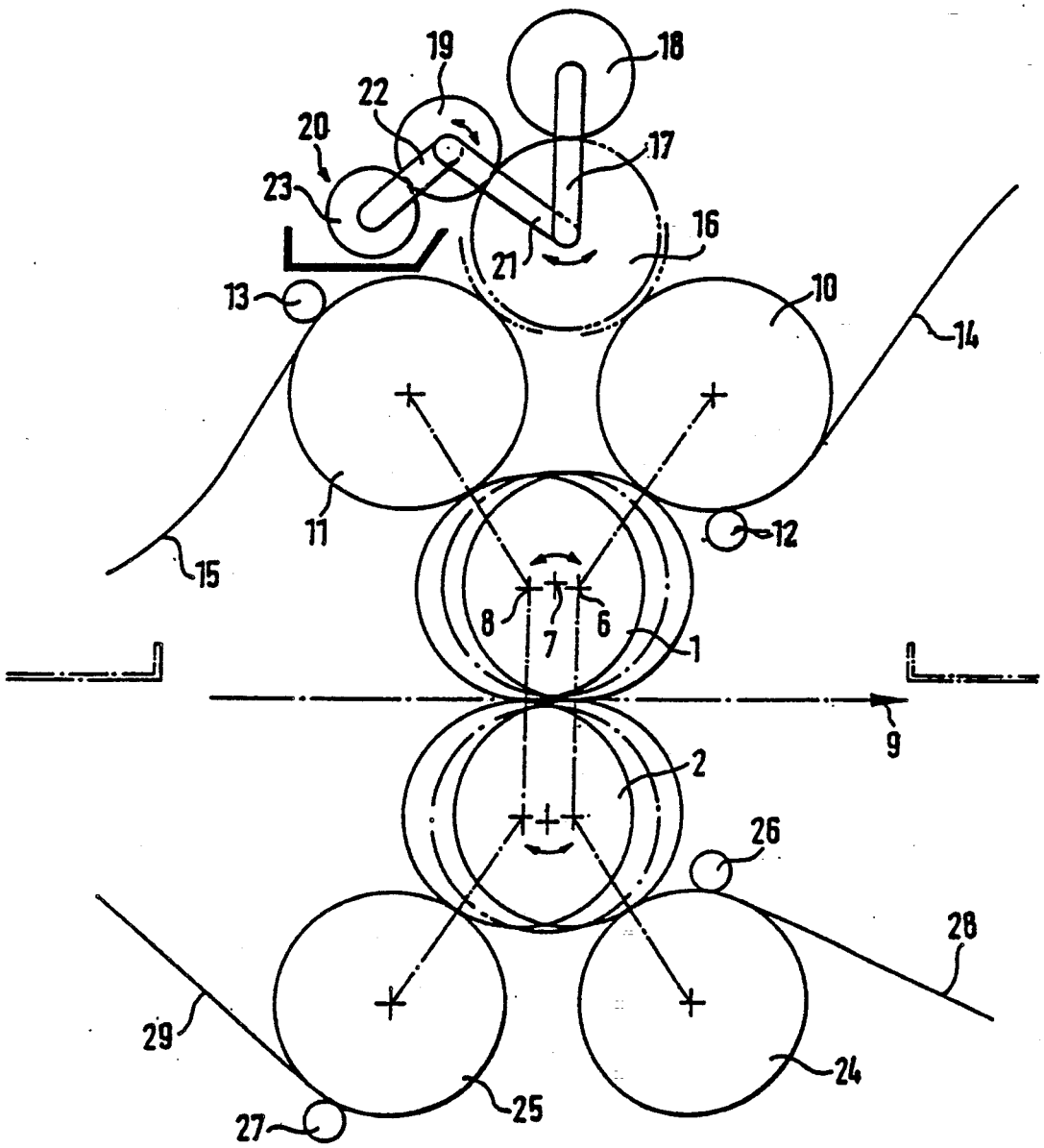
FIG. 1 is a highly schematic side view of a printing system in accordance with the present invention.

Two plate cylinders 10, 11 are in engagement with the blanket cylinder 1. The plate cylinders 10, 11 are spaced from each other, and are retained in the side walls of the printing machine in suitable bearings. FIG. 1 shows schematically the center axes of the cylinders. The plate cylinders 10, 11 are so located that the blanket cylinder 1, when in position 6, is engaged with the plate cylinder 10 and out of engagement with the plate cylinder 11. When in the axial position 8, the blanket cylinder 1 is engaged against the plate cylinder 11. In the position 7 between the positions 6 and 8, the blanket cylinder 1 is out of engagement with both the plate cylinders 10, 11. Additionally, in this central position 7, the blanket cylinder 1 as well as the impression blanket cylinder 2, as shown in FIG. 1 in chain-dotted circumferential representation, are out of engagement from each other, thus permitting threading of the web 9 therebetween.

Each one of the plate cylinders 10, 11 has a plate application guide roller 12, 13; 26, 27 associated therewith so that the respective printing plate 14, 15; 28, 29 to be applied to the respective plate cylinder can be smoothly rolled over the associated plate cylinder.

During printing, only one of the two plate cylinders 10, 11 is in engagement with the blanket cylinder 1 and with an ink application roller 16. The ink application roller 16 is retained at its axial ends in a positioning lever 17. The positioning lever 17 is pivotably secured to the axis of an ink transfer roller 18 which, for example, is a vibrator or axially oscillating roller. The roller 18 is coupled to a roller train of an inker system, not further shown, and which may be of any suitable construction.

A damping fluid supply roller 19 is in engagement with the ink application roller 16. The roller 19 forms part of a damper 20. The roller 19 is axially retained at its ends by two links or levers 21, 22, which form a knee lever system. The lever 21 can pivot about the axis or rotation of the ink application roller 16 at one end; the lever 22 can pivot about the axis of rotation of a fixed damping fluid roller 23. The link levers 21, 22 ensure engagement of the damping fluid application roller 19 with both the damper roller 23 as well as with the ink application roller 16. The damping liquid pick-up roller 23 operates in contact with a damping fluid, for example water in a trough, as well known and as shown only schematically.

The system can be varied; rather than using the link levers 21, 22, engagement springs can be used which bias engagement of the damping fluid roller 19 against the application roller 16 and against the damping fluid pick-up roller 23, or with respect to one of said rollers at least. Rather than using an ink application roller 16, two application rollers can be provided, which are pivotably positioned for pivoting about the axis of inker roller 18. The damper 20 is then preferably so arranged that it applies damping fluid to the inker roller 18; alternatively, each one of the plate cylinders may have an individual damper associated therewith.

The system, as illustrated, can provide both prime-and-verso printing, that is, perfecting printing. A second system is located beneath the one described in detail, and forming a mirror image thereof. The second system includes plate cylinders 24, 25, each one of which has a plate application guide roller 26, 27 for ease of introducing the respective printing plates 28, 29 to the associated plate cylinder. A combined ink-damping fluid application roller, not shown, is associated with the plate cylinders 24, 25, which can also have one or two dampers coupled thereto.

Of course, a plurality of printing systems as shown in FIG. 1 can be located in sequence along the path of the web 9, so that a complete multi-color printing machine assembly can be built, all including similar printing systems or printing unit structures, and each permitting flying printing plate change. By suitably inclining the axes of rotation of the blanket cylinders 1, 2 with respect to each other, which cause some wrap-around of the web 9 about the blanket cylinders, additional web guide elements can be eliminated. By so positioning the blanket cylinder 1 and the impression cylinder 2 with respect to each other that the axial components of the cylinders are at an angle with respect to each other, results in a wrap angle or partial wrapping of the web 9 about the cylinders 1, 2.

The drive and mechanical coupling of the blanket cylinder 1 with the impression cylinder 2 is best seen in FIG. 3. Shafts 30, 31 of the blanket cylinder 1 and of the impression cylinder 2 are located at both sides, of which only one is shown for simplicity, by eccenter bearings 4, 5 in the side wall 3. Gears 32, 33 are located on the shafts 30,31 of the respective blanket cylinders 1, 2. The gear 32 of the blanket cylinder 1 is a double gear, in which the gearing 34 of the gear 32 meshes with the gearing of gear 33 on shaft 31 of blanket cylinder 2. The gearing 35 of the gear 32, on shaft 30 of blanket cylinder 1, meshes with the gear 36 coupled to a fixed shaft 37 which is driven by the main printing machine drive.

OPERATION, AND FLYING PLATE CHANGE

To reposition the blanket cylinder 1 and the impression cylinder 2, pneumatic or hydraulic positioning piston-cylinder arrangements are engaged with the eccenter bearings 4, 5 as well known in the Printing machinery field. The eccenter bearings 4, 5 apply to the respective blanket cylinder 1, 2, upon change between the three possible positions 6, 7, 8, a curved and translatory movement. At the same time, the shaft 30 of the blanket cylinder 1, due to the gearing 35, rolls off about the gear 36 on the shaft 37 of the machine drive. The resulting rotary movement of the blanket cylinder 1, in circumferential direction, is transferred by the gearing 34 to the gear 33 on the impression cylinder 2. The gear 33 will rotate in a direction opposite to that of the gear 32 and the gearing 34 thereon.

The mechanical coupling of the blanket cylinder 1 with the impression cylinder 2 thus provides for compensation of the adjustment path S (FIG. 2) upon change in position of the blanket cylinder 1 and of the impression cylinder 2, for example from position 8 to position 6, by back-rotation of the point 38 (FIG. 2), that is, the impression line or printing line of the blanket cylinder 1 with the impression cylinder 2 about the distance S.

Figure 2:
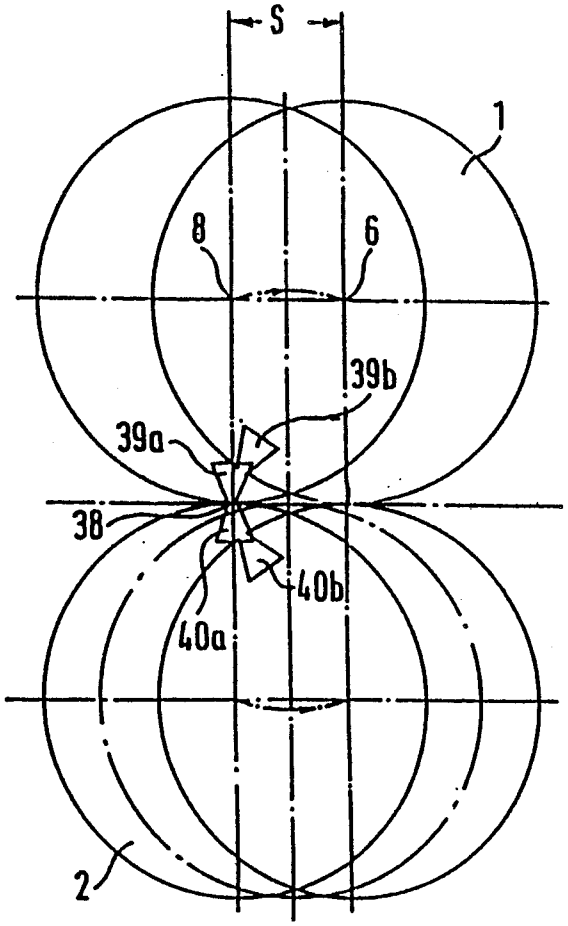
FIG. 2 is a schematic cross section through a blanket cylinder and an impression cylinder and illustrating various possible positions.

In FIG. 2, the clamping grooves 39*a* for the blanket on the blanket cylinder 1 and 40*a* for the blanket on the impression or counter blanket cylinder 2 engage or touch each other or are opposite each other when the blanket cylinders are in the position 8. In the position 6, the clamping groove 39*b* is offset from the clamping groove 40*b* by the distance S in circumferential direction of the blanket cylinder 1 and the impression or counter blanket cylinder 2. By compensation of the adjustment path S, register with respect to a subsequent printing system or a folding apparatus is maintained. Upon conjoint or common movement of the blanket cylinder 1 and of the impression cylinder 2 about the shaft 37 upon change between the positions 6 and 8 and passing through the central position 7, separation of the blanket cylinders 1 and the impression cylinders 2 is obtained, while the gearing 34 and the gear 33 are maintained in engagement.

The positions 6 and 8 define the minimal axial spacing between the blanket cylinder 1 and the impression or counter blanket cylinder 2.

The double gear 32 and the gear 33 each are in engagement with a further gear, not shown, which drives the respective plate cylinders 10, 11 and 24, 25, respectively, as well known and arranged in any suitable manner.

To stop the plate cylinder 10, 11; 24, 25, independently of machine drive, and, selectively, to drive the other one of the plate cylinders, electrically or otherwise controllable couplings or clutches are connected between the shafts of the plate cylinders 10, 11; 24, 25 and the respective drive gear. Thus, while the plate cylinder, with which the blanket cylinder 1 and the ink application roller 16 is engaged and rotates, the other plate cylinder can be disengaged by the aforementioned clutch or coupling and can be stopped, so that the printing plate on the other plate cylinder can be exchanged. The guide rollers 12, 13 inhibit touching of the printing plate which is being replaced with the rotating ink application roller 16 and the rotating blanket cylinder 1.

The use of plate guide and pull-in rollers 12, 13 not only greatly facilitates the application of printing plates on a plate cylinder but, also, is an important safety feature. It inhibits contact or engagement of the printing plate to be placed on a plate cylinder with the rotating ink application roller 16, as well as with the rotating blanket cylinders 1 or 2, respectively. This permits selective printing from one plate cylinder pair, and change-over to printing to another plate cylinder pair, without stopping the machine, that is, during a printing run. This change-over is possible since the drive of the corresponding plate cylinder is synchronized with the blanket cylinder with which it is engaged, by plate cylinder gears coupled, for example, to gears 32 and 33.

Various changes and modifications may be made within the scope of the inventive concept.

We claim:

1. Offset printing system permitting flying plate change having a machine frame (3);

two plate cylinders (10, 11; 24, 25) selectively, alternatingly operative for printing;

an inker (18) having an ink application roller (16), and a damper (20) associated with and in selective fluid transfer engagement with either one of said plate cylinders;

a blanket cylinder (1, 2) and an impression cylinder (2, 1) located for passing a printing substrate (9) between the blanket cylinder and the impression cylinder, said blanket cylinder and either one of said selectively operative plate cylinders (10, 11; 24, 25) forming a printing couple;

and comprising, in accordance with the invention, bearing means positioning the two plate cylinders (10, 11; 24, 25) of the system in the machine frame in an axially predetermined position with respect to each other;

eccentric means (4, 5) in the machine frame for adjustably journalling the blanket cylinder (1, 2) in the machine frame with its axis of rotation eccentrically movable between three positions (6, 7, 8) which place the blanket cylinder (1, 2), selectively, in engagement with either one of the plate cylinders to complete the printing couple, and with the impression cylinder to receive a printing image from the engaged plate cylinder, or with neither one of the plate cylinders, and out of engagement with the impression cylinder, for permitting threading of the substrate web (9) between the blanket cylinder (1, 2) and the impression cylinder (2, 1); and adjustable support means for supporting the ink application roller (16) selectively in engagement with either one of the plate cylinders (10, 11; 24, 25).

2. The printing system of claim 1 further comprising an additional similar printing system, in which one of said printing systems is the mirror image of the other printing system; and wherein the impression cylinder (2, 1) of one of said systems comprises the blanket cylinder of the other of said systems, to provide for perfecting and prime-and-verso printing on said printing substrate (9).

3. The system of claim 1, further including an ink transfer roller (18) in surface contact with said ink application roller (16);

and wherein the adjustable support means include pivotable means (17) coupled to said ink application roller (16), said pivotable means being movable about a pivot fulcrum coincident with an axis of rotation of said ink transfer roller(18).

4. The system of claim 1, wherein the system includes only a single damper (20), said damper having a damping fluid application roller (19) in surface engagement with said ink application roller (16).

5. The system of claim 4, including pivotable holding means (21), for the damping application roller (19), said holding means being pivotable about an axis of rotation of the ink application roller (16).

6. The system of claim 1, further including a plate guide and feed means (12, 13; 26, 27) associated with each plate cylinder (10, 11; 24, 25).

7. The system of claim 6, wherein said plate guide and feed means comprises guide and feed roller means (12, 13; 26, 27) for applying a printing plate (14, 15; 28, 29) to one of the plate cylinders during printing and rotation of the other of the plate cylinders.

8. The system of claim 1, wherein the blanket cylinder (1, 2) has a blanket cylinder shaft (30);

a dual gearing gear (32) located on said blanket cylinder shaft;

the impression cylinder (2) has a single gear (33) located on a shaft thereof, in gearing engagement with one of the gearings (34) of the dual gear (32) of the blanket cylinder shaft; and machine drive means (36, 37) including a gear (36) in engagement with another gearing (35) of the dual gear (32) on the blanket cylinder shaft.

9. The system of claim 2, further including an ink transfer roller (18) in surface contact with said ink application roller (16) of the respective system;

and wherein said ink application roller (16) is pivotably movable about a pivot fulcrum coincident with the axis of rotation of said ink transfer roller (18).

10. The system of claim 2, wherein each system includes only a single damper (20), said damper having a damping fluid application roller (19) in surface engagement with said ink application roller (16).

11. The system of claim 1O, wherein the axis of rotation (19) of the damping fluid application roller is pivotable about the axis of rotation of the ink application roller (16).

12. The system of claim 2, further including a plate guide and feed means (12, 13; 26, 27) associated with each plate cylinder (10, 11; 24, 25).

13. The system of claim 12, wherein said plate guide and feed means comprises guide and feed roller means (12, 13; 26, 27) for applying a printing plate (14, 15; 28, 29) to one of the plate cylinders during printing and rotation of the other of the plate cylinders.

14. The system of claim 2, wherein the blanket cylinder (1, 2) has a blanket cylinder shaft (30);

a dual gearing gear (32) located on said blanket cylinder shaft;

the second blanket cylinder (2}has a single gear (33) located on a shaft thereof, in gearing engagement with one of the gearings (34) of the dual gear (32) of the blanket cylinder shaft; and machine drive means (36, 37) including a gear (36) in engagement with another gearing (35) of the dual gear (32) on the blanket cylinder shaft (30).

* * * * *